US005137486A

United States Patent [19]

Glickman

[11] Patent Number: 5,137,486

[45] Date of Patent: Aug. 11, 1992

[54] MULTI-PLANAR CONNECTOR ELEMENT FOR CONSTRUCTION TOY

[75] Inventor: Joel I. Glickman, Huntingdon Valley, Pa.

[73] Assignee: Connector Set Toy Company, Hatfield, Pa.

[21] Appl. No.: 687,386

[22] Filed: Apr. 18, 1991

Related U.S. Application Data

[63] Continuation-in-part of Ser. No. 625,809, Dec. 11, 1990, Pat. No. 5,061,219.

[51] Int. Cl.[5] ..... A63H 33/06

[52] U.S. Cl. ..... 446/126; 446/124; 446/85

[58] Field of Search ..... 446/85, 105, 107, 120, 446/124, 125, 126

[56] References Cited

U.S. PATENT DOCUMENTS

| | | | |
|---|---|---|---|
| 1,113,371 | 10/1914 | Pajeau | 446/126 |
| 1,608,592 | 11/1926 | Funk . | |
| 1,707,691 | 4/1929 | Sweet | 446/126 |
| 1,843,115 | 2/1932 | Ferris | 446/126 |
| 1,898,297 | 2/1933 | Fox . | |
| 2,633,662 | 4/1953 | Nelson . | |
| 2,683,329 | 7/1954 | Kobler . | |
| 2,709,318 | 5/1955 | Benjamin | 446/126 X |
| 2,800,743 | 7/1957 | Meehan et al. . | |
| 2,895,753 | 7/1959 | Fentiman . | |
| 2,902,821 | 9/1959 | Kelly, Jr. | 446/120 X |
| 2,976,968 | 3/1961 | Fentiman . | |
| 3,275,351 | 9/1966 | Fentiman . | |
| 3,286,391 | 11/1966 | Mengeringhausen | 446/126 X |
| 3,564,758 | 2/1971 | Willis . | |
| 3,626,632 | 12/1971 | Bullock, Jr. . | |
| 3,648,404 | 3/1972 | Ogsbury et al. | 446/126 |
| 3,891,335 | 6/1975 | Feil . | |
| 4,078,328 | 3/1978 | Rayment | 446/126 X |
| 4,302,900 | 12/1981 | Rayner | 446/120 |
| 4,758,196 | 7/1988 | Wang . | |
| 4,988,322 | 1/1991 | Knudsen | 446/120 |

FOREIGN PATENT DOCUMENTS

| | | |
|---|---|---|
| 366230 | 11/1958 | Switzerland . |
| 2058590 | 9/1979 | United Kingdom . |

*Primary Examiner*—Robert A. Hafer
*Assistant Examiner*—Sam Rimell
*Attorney, Agent, or Firm*—Schweitzer, Cornman & Gross

[57] ABSTRACT

A connecting element for a construction toy is designed so that an assembly of two such connector elements provides for connections in each of two planes oriented at right angles to each other. Each connecting element is of generally flat form, of open construction, not unlike the configuration of a snowflake. The connector provides for a plurality of radially oriented strut-receiving sockets angularly spaced about the central axis of the connector. At one side, there is an open-sided recess extending from the outer edge to the central axis and of a size and shape to receive a connector element of like construction. Detent means are provided so that an assembled pair of connectors is locked together. In general, the sockets are arranged to require lateral, snap-in assembly of struts. However, the sockets located directly opposite the open-sided recess are designed to accommodate a twist-in assembly, as lateral assembly is precluded by the presence of a second, right angularly oriented connector element. The device is especially adapted for high volume production by injection molding techniques.

16 Claims, 2 Drawing Sheets

MULTI-PLANAR CONNECTOR ELEMENT FOR CONSTRUCTION TOY

RELATED APPLICATIONS

This application is closely related to, and constitutes a continuation-in-part of, my copending application Ser. No. 625,809, filed Dec. 11, 1990, now U.S. Pat. No. 5,061,219. The disclosure of said patent is incorporated herein by reference.

BACKGROUND AND SUMMARY OF THE INVENTION

In our above mentioned patent, we disclose a novel and improved form of construction toy comprising hub-like connector elements and strut-like structural elements adapted to be removably engaged with the connector elements to form composite structures. The patented device incorporates a variety of unique and advantageous features which greatly enhance its performance while at the same time enabling it to be mass produced at very low cost by injection molding techniques.

In the patented device, the hub-like connector is of a configuration not unlike a large snowflake, comprising a plurality of generally radially oriented sockets designed to accommodate lateral snap-in insertion of the structural elements. As set forth more fully in the patent, the connector elements are designed primarily to receive the strut-like structural elements in a radial array. However, provision is made for axial reception of a structural element through a center opening in the connector. In addition, by reason of a unique construction of the radial sockets and the strut-like structural elements, the sockets accommodate insertion of the structural elements oriented at right angles to the normal radial axis. Nevertheless, with the connector elements of the prior invention, there are certain limitations in the orientation of structural elements, when these elements are not arranged in the principal plane of the hub-like connector elements.

Pursuant to the present invention, a novel and advantageous form of connector element is provided, which enables one connector to be joined with another, in planes which are disposed at right angles to each other. A pair of thus joined connector elements provides for an assembly with structural elements in two principal planes. In addition, each of the available sockets still retains the ability to lockingly receive structural elements oriented at right angles to the principal plane of the hub-like connector element. Accordingly, the structural possibilities, using the connector element of our before mentioned patent, together with the improved device of the invention, are greatly enlarged and the usefulness of the system correspondingly increased.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
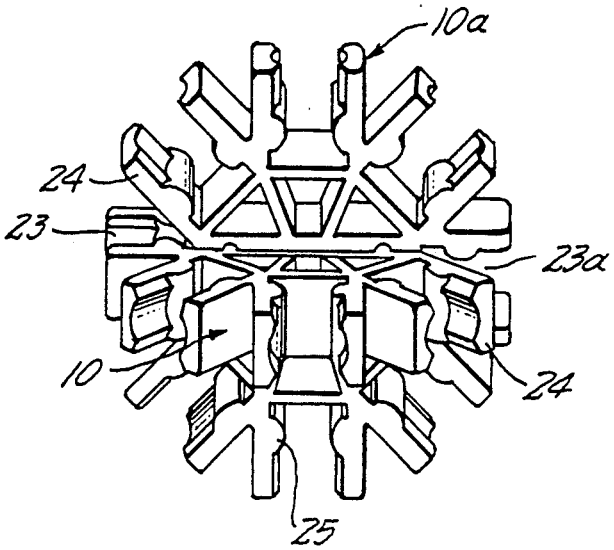
FIG. 1 is a perspective view of an assembly of a pair of connector elements according to the present invention.
Figure 2:
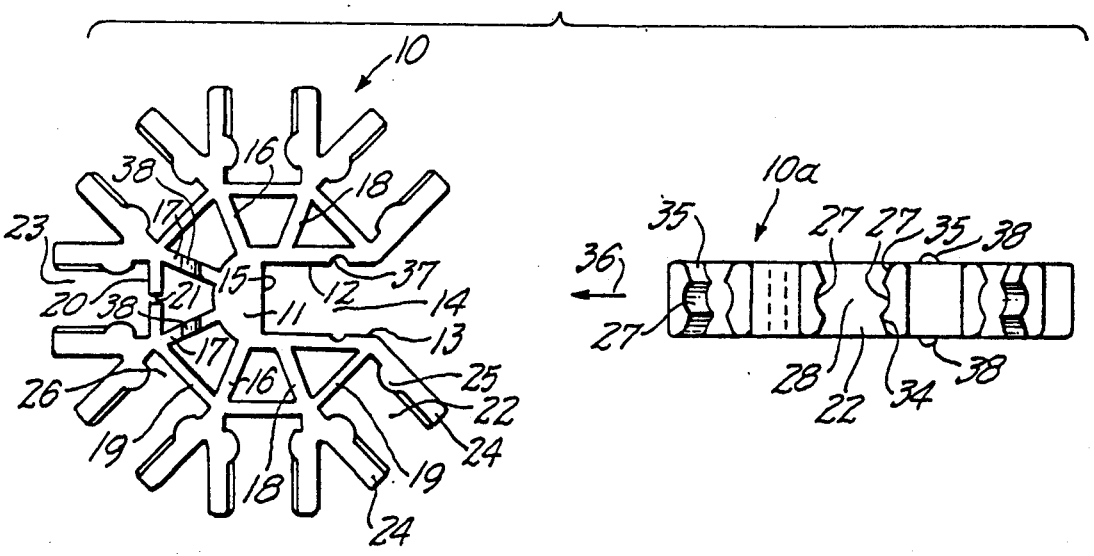
FIG. 2 is an exploded view showing the component elements of the assembly of FIG. 1 and illustrating the manner in which such components are assembled.
Figure 3:
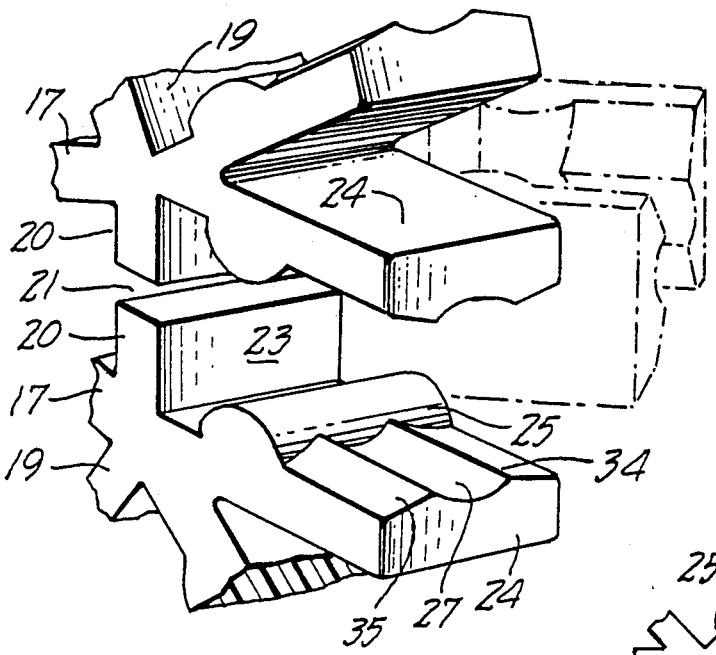
FIG. 3 is a greatly enlarged, fragmentary perspective view of a connector element according to the invention, illustrating details of one of the strut-receiving sockets thereof.

Referring now to the drawing, and initially to FIGS. 1 and 2 thereof, the connector element of the invention is generally designated by the reference numeral 10. It has the general "snowflake" configuration of the device of the before mentioned patent, and has many of the structural features of the before mentioned device, but is specially modified to accommodate assembly with a second, similarly configured connector element oriented at right angles thereto. The connector element 10 is generally of a flat, open configuration, typically about $\frac{1}{4}$ inch in thickness, and typically formed by injection molding of a structural plastic, such as acetyl copolymer.

At its center, the connecting element has a solid, semi-cylindrical core 11. Guide walls 12, 13 extend from opposite sides of the core 11, in spaced-apart, parallel relation. The spacing between the guide walls 12, 13 is substantially equal to the thickness of the connector element, allowing for a second such element to be received within the recess 14 defined by the spaced-apart guide walls 12, 13 and a flat transverse wall 15 which forms one side of the core 11 and is positioned on an axial plane passing through the connector element.

Extending radially outward from the core are a plurality of spoke-like elements 16–18 which, at their outer ends, join with peripheral walls 19, 20. In the illustrated arrangement, the walls 19, 20 define seven sides of a generally octagonal structure, with the eighth side being open to accommodate the recess 14. As is evident in FIG. 2, the several walls 19 extend continuously from one spoke to the other (or from a spoke to the guide walls 12, 13). The wall 20, which lies directly opposite the recess 14 is, however, formed with a discontinuity 21 the function of which will be explained hereinafter.

Each of the walls 19, 20 forms the end wall of a strut-receiving socket 22 (in the case of the walls 19) or 23 (in the case of the interrupted wall 20). As described more fully in the above mentioned patent, each of the sockets is defined by pairs of opposed gripping elements 24, which extend in spaced parallel relation in a generally radially outward direction. Each of the gripping elements 24 is provided internally with a semi-cylindrical locking projection 25, which extends at right angles to the generally radial axis of the socket 22 or 23. The locking projections, in conjunction with the base walls 19, 20, define flange-receiving recesses 26.

The outer portions of the gripping elements 24 are formed with concave grooves 27 which are concentric with respect to the generally radial axis 28 of the socket.

These grooves extend radially from the locking projections 25 to the ends of the gripping elements 24.

Figure 4:
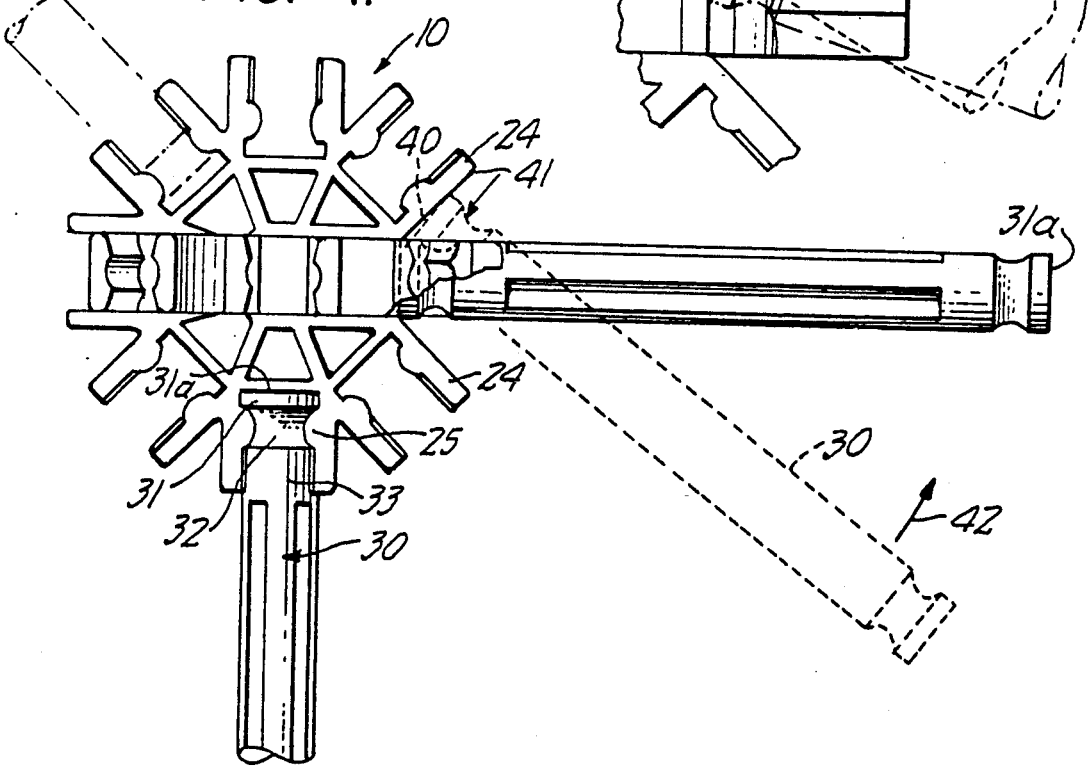
FIG. 4 is an elevational view of the assembly of FIG. 1, illustrating the manner in which strut-like structural elements are assembled therewith.

As shown in FIG. 4, and as explained more fully in the before mentioned patent, strut-like structural elements 30, used with the connector elements 10, are provided at their end extremities with cylindrical end flanges 31 and adjacent annular grooves 32. Immediately adjacent the annular groove 32 is a cylindrical portion 33, which is received snugly in the concave grooves 27 of the gripping elements. The contours of the locking flange 31 and groove 32 are complimentary with the flange-receiving recesses 26 and the locking projections 29, as is reflected in FIG. 4. The structural member 30 is (sometimes referred to as a strut) normally assembled with the connector element 10 by being pressed laterally into one of the recesses 22. As indicated in FIG. 2, the lateral entrance to the recess 22 is partially closed by a narrow throat section, defined by upper and lower edges 34 of the cylindrical grooves 27. Divergent guide surfaces 35 are provided to facilitate lateral insertion of the structural elements, during which the outer portions of the guide arms 24 are elastically deflected apart sufficiently to accommodate lateral entrance of the structural element. Once received within the recess 22, the structural element is locked against axial displacement by the cooperation of the flange 31, the flange-receiving recess 26, the opposed locking projections 25 and the annular groove 32. The structural element 30 is locked against lateral movement by the clamping action of the gripping arms 24.

To particular advantage, the configuration of the sockets and struts is such that, when a strut end is received in a socket, the flat flange end wall 31*a* of the strut is resiliently urged into firm face to face contact with the flat base wall 19 (or 20) of the socket. This arrangement adds significant stability and rigidity to an assembly of parts. The desired relationship is achieved by displacing the locking flanges 25 slightly in the direction of the socket end wall 19, with respect to the "normal" position of the strut groove 32. Thus, when the strut is snapped into assembled position it is automatically pressed toward the bottom of the socket to urge the flat walls 31*a* and 19 into tight face to face contact.

With reference now to the exploded view of FIG. 2, the reference numeral 10*a* designates generally a second connector element, identical to the connector element 10, but oriented so that its principal plane lies at right angles to that of the element 10 and also so that its recess side (not shown in FIG. 2) faces the recess 14 of the element 10. When these two elements 10, 10*a* are moved together, in the direction of the arrow 36, the portion of the connector 10 to the left of the end surface 15 is received by the recess of the connector element 10*a*. Likewise, the recess 14 of the element 10 receives the right-hand portion of the element 10*a*. The completed assembly of the two connecting elements 10, 10*a* is evident in the perspective view of FIG. 2. The assembled connectors, as is evident in FIG. 1 provide radially oriented strut-receiving recesses in two planes, so that the structural possibilities of the system are greatly enhanced.

To secure the two connector elements 10, 10*a* in assembled relation, cooperating ribs and grooves are formed on the respective parts. In the structure specifically illustrated herein, the guide walls 12, 13 are provided with transverse detent grooves 37. These are arranged to receive appropriately located detent ribs 38 on the opposite connector element. The ribs 38, as indicated in FIG. 2, are formed on the radial spokes 17. During assembly of a pair of connector elements 10, 10*a*, as the projecting ribs 38 reach the outer end of the guide walls 12, 13, the guide walls are elastically displaced outwardly a distance sufficient to accommodate the presence of the ribs. This elastic displacement is facilitated by providing a small gap 21 in the recess wall 20. Thus, during the assembly process, the opposite halves of the divided wall 20 are displaced toward each other, facilitating the outward displacement of the guide walls 12, 13. This process is happening simultaneously on both of the connector elements 10, 10*a*, as will be understood. When the two connector elements are fully assembled, the ribs 38 are aligned with and received in the transverse grooves 37, allowing the guide walls to return elastically to their normal positions and lockingly engaging the two parts against accidental separation.

The single plane connector element described in our before mentioned patent is formed with a symmetrical array of strut-receiving sockets. In an advantageous embodiment, there are eight such sockets arranged in four opposed pairs on opposite sides of the connector. The individual connector elements 10, 10*a*, on the other hand, are formed with one less strut-receiving socket, by reason of the open-sided recess 14 at one side of the connector. Nevertheless, when the two elements are assembled, as reflected in FIG. 1, for example, each connector element contributes, in effect, a strut-receiving socket to the other connector element, so that there are four pairs of opposed sockets in each plane.

As can be appreciated from examination of the various figures, when two of the connecting elements are assembled in the manner of FIG. 1, three opposed pairs of sockets on each connecting element are open and accessible for lateral insertion of a strut 30. However, the case of one of the opposed pairs of sockets, designated as 23, 23*a*, normal lateral insertion of a strut is precluded by the immediate adjacency of outwardly extending gripping elements 24 carried by the opposite connecting element of the assembly. That is, the strut-receiving socket 23 of the connector 10 has its open sides partially blocked by gripping elements 24 extending from the vertically oriented connecting element 10*a*. Likewise, the socket 23*a* provided by the vertically oriented connecting element 10*a* has its open side blocked by gripping arms 24 extending from the horizontal connecting element 10.

Figure 5:
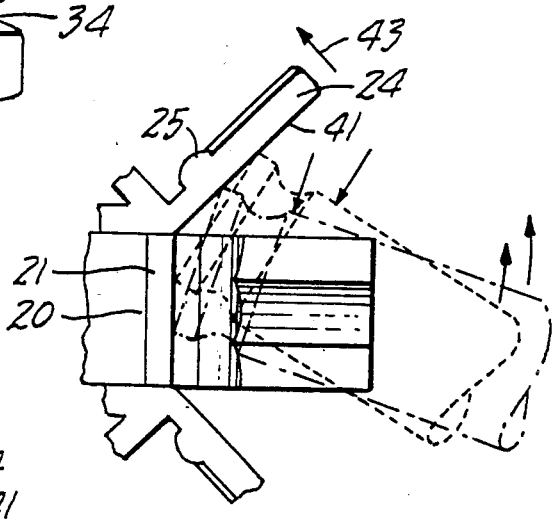
FIG. 5 is an enlarged, fragmentary sectional view, illustrating the manner in which a structural element is inserted in certain of the sockets of the connector element, located on intersecting planes of a pair of assembled connector elements.

Pursuant to the invention, insertion of a strut element 30 into the partially inaccessible sockets 23, 23*a* is facilitated by reason of the slotted recess wall 20. The provision of the slot 21 therein enables limited outward displacement of the adjacent gripping arms 24 to a degree sufficient to enable a strut element to be "cammed" into position through a levering motion, illustrated schematically in FIGS. 4 and 5.

With reference to FIG. 4, the position of the strut 30 shown in broken lines represents a typical starting position for inserting a strut into a socket 23*a* of a connecting element 10*a*. The end surface 40 of the strut is placed against an outer surface 41 of the adjacent gripping arm, and this serves somewhat as a guide as the strut is pushed laterally into the socket, while generally holding the angular orientation shown in FIG. 4. During this operation, there is an initial outward displacement of the opposed gripping arms. This is accommodated by the slot 21, which tends to open up wider than normal. In addition, the recess guide wall 12 is deflected outward slightly, and this is encouraged by a levering action of the strut 30 in the direction of the arrow 42 of FIG. 4. This has the effect of prying upwardly against the guide surface 41, so that the adjacent gripping arm 24 is displaced in the direction of the arrow 43 in FIG. 5. Levering of the strut, as reflected in the multiple illustrations of FIGS. 4 and 5, continues until the flanged end of the strut snaps into place in the recess, as shown in full lines in FIG. 4. This allows the displaced parts to return to their normal positions, with the strut gripped firmly and for all practical purposes normally, in the socket.

Removal of a strut from one of the partially blocked recesses 23 or 23*a* is accomplished by a generally reverse procedure. While it might be possible to execute the levering assembly of a strut into a partially blocked recess even if the slot 21 were not provided, it would require considerably more force, with some risk of overstressing the parts. More importantly, however, the provision of the slot 21 simplifies the task of assembly by small children, who are of course a targeted market for this type of product.

The device of the invention has unique and significant advantages. It greatly facilitates multi-planar and other complex structures utilizing the devices of this invention in conjunction with those of my before mentioned patent.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A multi-planar connector element for a construction toy of the type utilizing a plurality of struts and connector elements for engaging the ends of said struts, which comprises (a) a central core defining a central axis of said connector element, (b) a plurality of strut-receiving sockets arranged generally radially about said core, (c) said sockets being oriented to receive and retain struts in radial orientation relative to said central core, (d) said core and sockets forming a connector of generally flat configuration and of predetermined thickness, (e) an open-sided recess in one side of said connector element, extending to said central axis and having a width equal to the thickness of the connector element, (f) said open-sided recess receiving a second connector element of the same size and configuration, oriented in a plane at right angles to the plane of the first connector element, to form a composite connector element having strut-receiving sockets radiating in two right angularly related planes.

2. A multi-planar connector element according to claim 1, further characterized by, (a) said connector having a strut-receiving socket directly opposite said open-sided recess whereby, in an assembly of first and second joined connector elements, the second connector element has a strut-receiving socket at the location of the open-sided recess in the first connector element.

3. A multi-planar connector element according to claim 1, further characterized by, (a) said connector element including an odd numbered plurality (n) of said sockets positioned in equi-angularly spaced relation about said core at intervals of $360/(n+1)$ degrees, (b) said open sided recess lying on a radial axis spaced equally between the adjacent sockets on each side thereof.

4. A multi-planar connector element for a construction toy of the type utilizing a plurality of struts and connector elements for engaging the ends of said struts, which comprises (a) a central core defining a longitudinal axis of said connector element, (b) a odd-numbered plurality of (n) strut-receiving sockets arranged around said core about uniformly spaced radial axes, (c) said axes being spaced apart at $360/(n+1)$ degrees, (d) said sockets each comprising a pair of spaced-apart gripping arms, extending in the direction of the radial axis of said socket, and an end wall defining radially outwardly opening socket, (e) said gripping arms having inwardly extending strut-locking projections thereon, (f) said struts having annular grooves adjacent their end extremities adapted for the reception of said locking projections, (g) said gripping arms having radially oriented, concave gripping portions thereon for engagement with a strut and accommodating lateral snap-in assembly of a strut into a socket, (h) said sockets and said core defining a connector element having generally flat, spaced-apart axial end faces and forming a connector element of predetermined thickness, and of a diameter substantially greater than said predetermined thickness, (i) a pair of spaced-apart parallel guide walls extending radially outwardly from said longitudinal axis and defining an open sided recess, (j) said guide walls being spaced apart a distance substantially equal to said predetermined thickness, whereby said connector element may be joined with a second, similar element to form a multi-planar assembly providing strut-receiving sockets in two right-angularly related planes.

5. A multi-planar connector element according to claim 4, further characterized by, (a) said guide walls having detent means of a first type therein, and (b) portions of said connector element located diametrically opposite said open sided recess being formed with detent means of a second type engageable with recess means of said first type for lockingly engaging a pair of connector elements in assembled relation.

6. A multi-planar connector element according to claim 5, further characterized by, (a) said connector element having a plurality of spoke elements extending radially from said core and supporting said end walls in radially outwardly spaced relation to said core, and said detent means of said second type being formed on certain of said spoke elements positioned generally opposite to said open-sided recess.

7. A multi-planar connector element according to claim 5, further characterized by, (a) one of said end walls being slotted to form two wall sections separated by a predetermined space, (b) said slotted end wall facilitating displacement of one of said guide walls away from the other during the assembly of two connector elements and the engagement of their respective detent means.

8. A multi-planar connector element according to claim 7, further characterized by, (a) said slotted end wall being located diametrically opposite said open-sided recess and further functioning to facilitate displacement of the gripping arms associated therewith away from each other to accommodate the non-lateral assembly of a strut into the socket defined in part by said slotted end wall.

9. In a construction toy having a connector element provided with one or more laterally open sockets and a strut element adapted to be inserted laterally in said sockets, (a) said connector element including a pair of spaced apart gripping arms formed with longitudinally extending groove means for the snap-in reception of said strut element, (b) opposed locking projections on said gripping arms extending transversely thereto and extending into the space between said gripping arms, (c) said strut having an annular groove adjacent one end adapted to receive and be guided and retained by said locking projections, (d) said socket having a base wall forming an end of said socket, (e) said strut element having an end flange defined in part by said annular groove and an end face spaced from said groove configured to be supported axially by said base wall, (f) the spacing between the end face and annular groove of said strut element being effectively greater than the spacing between the end wall and locking projections of said socket, such that, when said strut element is assembled in said socket, the end face of said strut element is urged firmly and resiliently into contact with said end wall.

10. A multi-planar connector element for a construction toy of the type utilizing a plurality of struts and connector elements for engaging the ends of said struts, which comprises (a) a central core defining a central axis of said connector element, (b) a plurality of strut-receiving sockets arranged generally radially about said core, (c) said core and sockets forming a connector of generally flat configuration and of predetermined thickness, (d) an open-sided recess in one side of said connector element, extending to said central axis and having a width equal to the thickness of the connector element, (e) said open-sided recess receiving a second connector element of the same size and configuration, to form a composite connector element having strut-receiving sockets radiating in two planes, (f) said open-sided recess being defined by a pair of spaced-apart, parallel guide walls for receiving the second connector element, said guide walls having detent means therein cooperating with detent means on the second connector element to retain an assembled pair of connector elements in joined relation.

11. A multi-planar connector element according to claim 10, further characterized by, (a) said connector element having a plurality of sockets, each comprised of a pair of gripping arms and a end wall, (b) the end walls of adjacent sockets being adjacent and integrally joined, and (c) at least one of said end walls being slotted to form a gap, to accommodate outward deflection of said guide walls during assembly of first and second connector elements prior to engagement of said detent means.

12. A multi-planar connector element according to claim 11, further characterized by, (a) said connector element having a strut-receiving socket located directly opposite said open-sided recess, and (b) said last mentioned socket having said slotted end wall.

13. A multi-planar connector element according to claim 12, further characterized by, (a) said sockets being configured for lateral, snap-in reception of end portions of said struts, and (b) the gripping arms of said last mentioned socket being separable upon displacement of the parts of said slotted end wall, to accommodate assembly of a strut by other than lateral, snap-in reception.

14. A multi-planar connector element according to claim 13, further characterized by, (a) said sockets having axes extending generally radially from said core, (b) the gripping elements of said sockets having locking projections extending transversely with respect to said axes and projecting partly into said sockets from opposite sides, (c) said struts having annular grooves at each end for locking engagement with said locking projections, (d) the socket opposite said open-sided recess accommodating insertion of a strut at a large angle to the radial axis of the socket while the gripping arms of said socket and the parts of said slotted end wall are displaced apart.

15. A multi-planar connector element for a construction toy of the type utilizing a plurality of struts and connector elements for engaging the ends of said struts, which comprises (a) a central core defining a central axis of said connector element, (b) a plurality of strut-receiving sockets arranged generally radially about said core, (c) said core and sockets forming a connector of generally flat configuration and of predetermined thickness, (d) an open-sided recess in one side of said connector element, extending to said central axis and having a width equal to the thickness of the connector element, (e) said open-sided recess receiving a second connector element of the same size and configuration, to form a composite connector element having strut-receiving sockets radiating in two planes, (f) said connector element including an odd numbered plurality (n) of said sockets positioned in equi-angularly spaced relation about said core at intervals of $360/(n+1)$ degrees, (g) said open sided recess lying on a radial axis spaced equally between the adjacent sockets on each side thereof, (h) said sockets each being disposed along a radial axis extending from said core and each comprising a pair of spaced-apart gripping arms and an end wall, (i) the end walls of adjacent sockets being integrally joined and constituting a continuous wall structure extending from one side of the recess to the other, interrupted by a gap in the end wall of a socket directly opposite from said recess.

16. A multi-planar connector element according to claim 15, further characterized by, (a) first detent means provided in conjunction with said recess, (b) second detent means provided in conjunction with portions of said connector directly opposite said recess, (c) said first and second detent means being of different type, and each of a type adapted to mate with detent means of the other type whereby, upon assembly of a pair of connector elements, the first detent means on one of said connector elements mates with the second detent means of the other of said connector elements.

* * * * *